US010864538B2

(12) United States Patent
Allis et al.

(10) Patent No.: US 10,864,538 B2
(45) Date of Patent: Dec. 15, 2020

(54) DUAL CHAMBER BACKPACK SPRAYER

(71) Applicant: Chapin Manufacturing, Inc., Batavia, NY (US)

(72) Inventors: Morgan Allis, Buffalo, NY (US); David Dubiel, N. Chili, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 72 days.

(21) Appl. No.: 16/352,132

(22) Filed: Mar. 13, 2019

(65) Prior Publication Data

US 2020/0290072 A1 Sep. 17, 2020

(51) Int. Cl.
*B05B 9/08* (2006.01)

(52) U.S. Cl.
CPC ..... *B05B 9/0822* (2013.01); *B05B 9/08* (2013.01); *B05B 9/0805* (2013.01); *B05B 9/085* (2013.01); *B05B 9/0861* (2013.01)

(58) Field of Classification Search
CPC ..... B05B 9/0822; B05B 9/08; B05B 9/0805; B05B 9/085; B05B 9/0861
USPC ..... 239/152, 154, 302, 303, 304, 307, 308, 239/332, 333, 373; 222/175
See application file for complete search history.

(56) References Cited

U.S. PATENT DOCUMENTS 5,335,853 A * 8/1994 Wirz ..... B05B 9/0877 239/154
6,412,707 B1 7/2002 Wirz
6,799,700 B2 10/2004 Durant et al.
7,093,741 B2 8/2006 Durant
7,556,210 B2 * 7/2009 Mandell ..... B05B 7/0093 239/304
7,854,396 B2 12/2010 Wu
7,905,428 B1 3/2011 Probasco
8,371,477 B2 2/2013 Klopfenstein et al.
8,556,192 B2 * 10/2013 Wise ..... F04B 17/06 239/152
8,998,110 B2 4/2015 Nishimura
9,027,790 B2 5/2015 Ciavarella et al.
9,079,200 B2 7/2015 Fornaro et al.
9,539,598 B2 1/2017 Ciavarella et al.
2005/0161529 A1 7/2005 Durant
(Continued)

FOREIGN PATENT DOCUMENTS

CN 102019243 4/2011
DE 19923364 12/1999
(Continued)

*Primary Examiner* — Steven J Ganey
(74) *Attorney, Agent, or Firm* — Woods Oviatt Gilman LLP; Katherine H. McGuire, Esq.

(57) ABSTRACT

A dual chamber backpack sprayer system includes first, second and third tanks, and a pump unit. The first tank includes a first tank housing defining an open internal volume configured to hold a diluent therein. The second tank is dimensioned to be received within the internal volume of the first tank and is configured to hold a pressurized fluid therein. The third tank includes a third tank housing configured to hold a liquid concentrate therein. The pump unit is fluidly coupled to the first tank, the second tank and the third tank. The pump unit is configured to receive the diluent from the first tank and the liquid concentrate from the third tank to produce a mixed fluid. The mixed fluid is delivered to the second tank as the pressurized fluid.

8 Claims, 8 Drawing Sheets

(56) References Cited

U.S. PATENT DOCUMENTS

| | | | |
|---|---|---|---|
| 2017/0028416 | A1 | 2/2017 | Duitsman |
| 2017/0232458 | A1 | 8/2017 | Wirz Luchsinger |

FOREIGN PATENT DOCUMENTS

| | | |
|---|---|---|
| JP | 2004195426 | 7/2004 |
| WO | 2007021203 | 2/2007 |

* cited by examiner

DUAL CHAMBER BACKPACK SPRAYER

FIELD OF THE INVENTION

The present invention generally relates to sprayers, and more particularly to a backpack style sprayer, and still more particularly to a dual chamber backpack style sprayer configured to dilute a fluid concentrate with a diluent prior to spraying.

BACKGROUND OF THE INVENTION

Sprayers, such as backpack sprayers are used across an array of applications, including farms, golf courses and residential properties, to apply water or other liquids, such as fertilizers or pesticides including herbicides, insecticides and the like. As the name implies, backpack sprayers are designed to be worn by the user, such as through securing a tank of the sprayer against the user's back via one or more shoulder straps. A handheld spray wand is fluidly coupled to the tank and is manually actuated, such as through a trigger, to dispense fluid from the tank through the spray wand. To pressurize the fluid for delivery to the wand, backpack sprayers typically include a pump and may be configured as battery powered pump sprayers or manually actuated pump sprayers.

In use, a backpack sprayer tank is filled with a selected fluid composition that is to be applied. By way of example, pesticide solutions may be anywhere from about 1% to about 10% active chemical in water. In one scenario, a user may spray a diluted herbicide solution, such as to target thistle. However, to apply a second pesticide solution, such as a diluted insecticide to fruit trees, the user will first have to completely empty the tank of the herbicide solution before rinsing the tank of any residual chemicals and finally refilling the tank with the desired insecticide solution. As may be readily apparent from the above, there are numerous drawbacks to such systems. For example and without limitation, such drawbacks may include waste of chemicals, the need for controlled disposal of unused chemicals, the time consuming need to thoroughly clean the tank between applications and the potential for cross-contamination and application of unwanted chemicals after incomplete or unsuccessful cleaning of the tank.

To alleviate some of the above-referenced drawbacks of these backpack sprayers, systems have been developed which segregate the chemical portion from the water/diluent portion of the system. In such systems, the chemical may be stored in a smaller, separate tank than the large diluent/water tank. Metering devices may then add chemical to a flow of water prior to emission from the wand. In this manner, the chemical remains isolated from the water tank, thereby minimizing or avoiding possible contamination of the water source. However, heretofore systems required complex plumbing regimes and interconnectivities of the various components making such systems difficult to use and burdensome to operate and clean.

Thus, there remains a need for a sprayer that segregates the chemical tank from the water tank but is also more easily plumbed, operated and cleaned. The present invention satisfies this as well as other needs.

SUMMARY OF THE INVENTION

In view of the above and in accordance with an aspect of the present invention, the present invention is generally directed to a dual chamber backpack sprayer system which includes first, second and third tanks, and a pump unit. The first tank includes a first tank housing defining an open internal volume configured to hold a diluent therein. The second tank is dimensioned to be received within the internal volume of the first tank and is configured to hold a pressurized fluid therein. The third tank includes a third tank housing configured to hold a liquid concentrate therein. The pump unit is fluidly coupled to the first tank, the second tank and the third tank. The pump unit is configured to receive the diluent from the first tank and the liquid concentrate from the third tank to produce a mixed fluid. The mixed fluid is delivered to the second tank as the pressurized fluid.

In a further aspect of the present invention, the pump unit may be a manually actuated pump or an electrically driven pump. The electrically driven pump may be a battery powered pump. Additionally, the third tank housing may also be selectively removably mounted to said the tank housing, thereby allowing for quick and easy swapping of chemical concentrates.

Additional objects, advantages and novel aspects of the present invention will be set forth in part in the description which follows, and will in part become apparent to those in the practice of the invention, when considered with the attached figures.

DETAILED DESCRIPTION OF THE PREFERRED EMBODIMENTS

Figure 1:
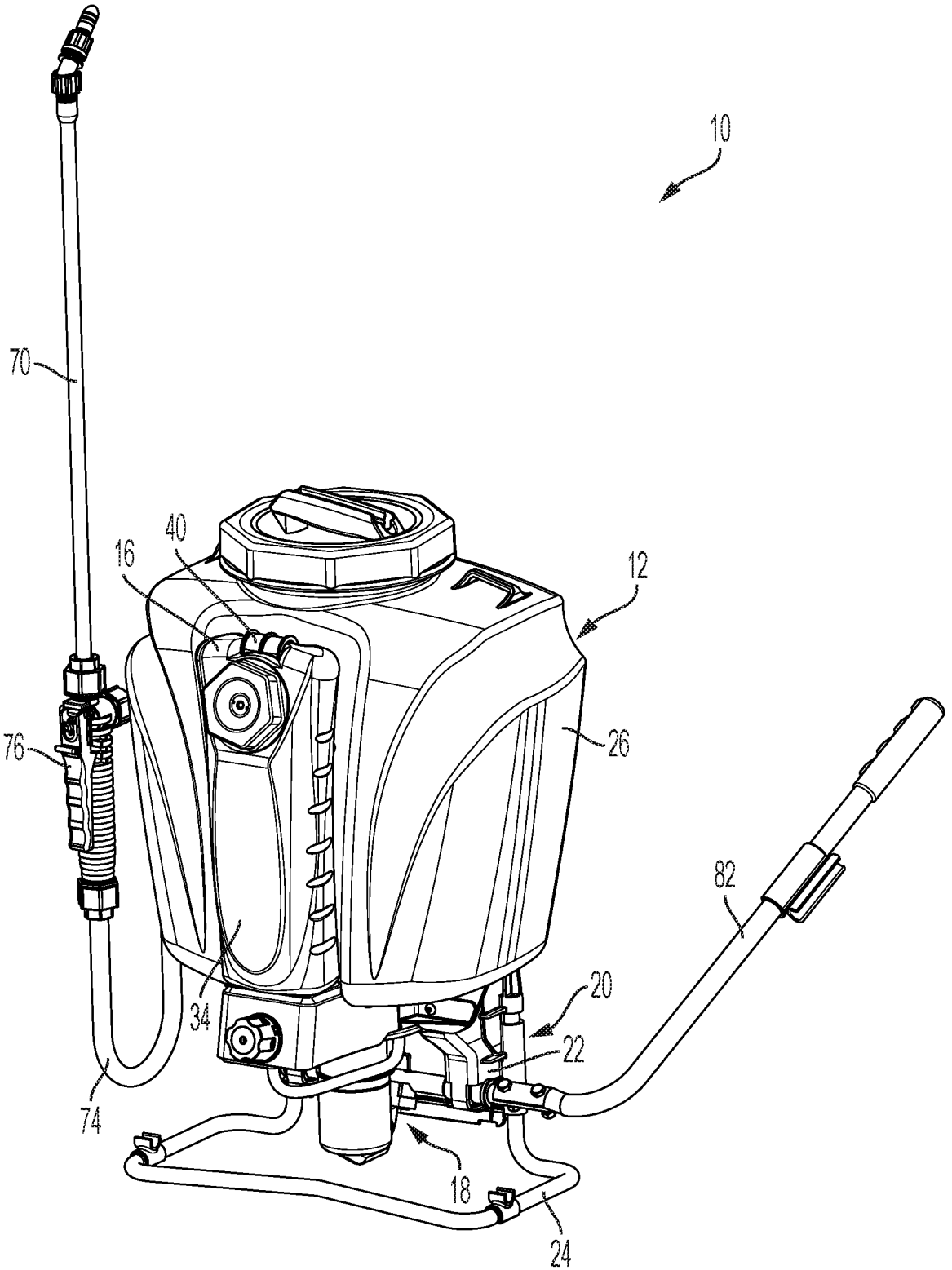
FIG. 1 is a perspective view of a manually actuated sprayer system in accordance with an aspect of the present invention.
Figure 2:
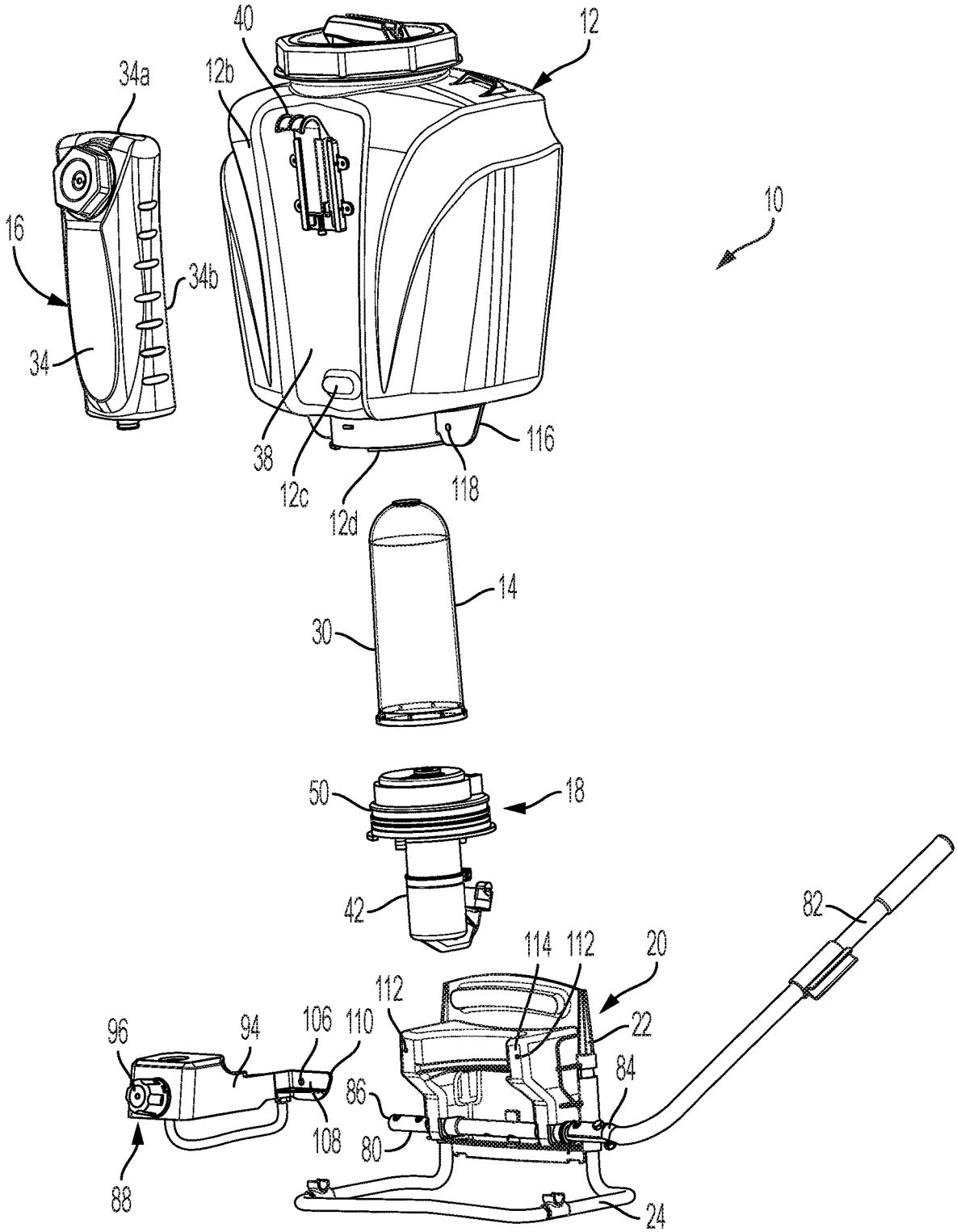
FIG. 2 is an exploded view of the sprayer system shown in FIG. 1.
Figure 3:
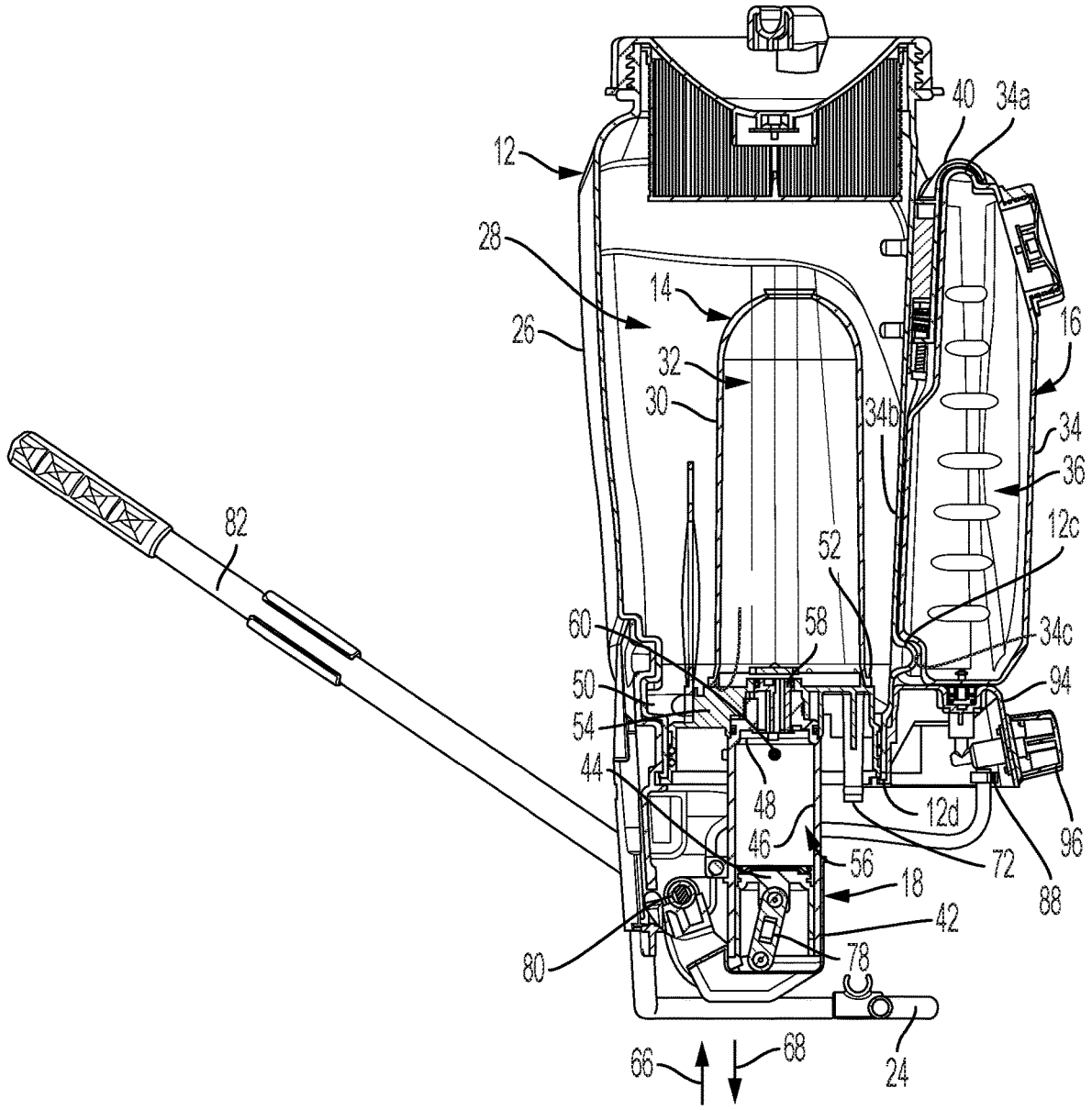
FIG. 3 is a side cross section view of the sprayer system shown in FIG. 1.

Referring now to the drawings, and with particular reference to FIGS. 1-3, in accordance with an aspect of the present invention, a backpack sprayer system 10 may generally comprise a first tank 12, a second tank 14, a third tank 16 and a pump unit 18. Tanks 12, 14 and 16, along with pump unit 18, may be mounted onto a modular backpack frame 20 comprising a frame plate 22 and support member 24, such as that shown and described within commonly owned U.S. patent application Ser. No. 16/351,882 filed on Mar. 13, 2019, the entirety of which is hereby incorporated by reference. Rear wall 12*a* of first tank 12 and rear surface 22*a* for frame plate 22 may each have a curved profile so as to more ergonomically rest against a user's back during use.

First tank 12 includes a first tank housing 26 which defines an open internal volume 28 which receives a diluent, such as water, therein. Second tank 14 is dimensioned to be received within open internal volume 28. Second tank 14 includes a second tank housing 30 defining a pressurized fluid chamber 32 which is configured to receive a pressurized fluid therein, as will be described in greater detail below. Third tank 16 includes a third tank housing 34 defining a liquid concentrate chamber 36 configured to receive a chemical concentrate, such as liquid fertilizer or pesticide, therein.

In accordance with an aspect of the present invention, third tank 16 may be selectively removable from first tank 12. To that end, front wall 12*b* of first tank 12 may define a recess 38 within which at least a portion of third tank housing 34 may be received. To releasably secure third tank 16 to first tank 12, front wall 12*b* may include a clip 40 thereon. Clip 40 may be a flexible but rigid member which is dimensioned and positioned so as to engage at least a portion of top wall 34*a* of third tank housing 34. Front wall 12*b* may also include a nodule 12*c* which is configured to seat within a corresponding notch 34*c* defined along rear wall 34*b* of third tank housing 34 when third tank 16 is properly positioned within recess 38. Clip 40 may flex upwardly to allow passage of top wall 34*a* thereby, with clip 40 then returning to its resting position to hold third tank 16 against first tank 12. To remove third tank 16, third tank 16 may be pulled outwardly of first tank 12 which will flex clip 40 until top wall 34*a* clears clip 40, at which time third tank 16 may be removed and clip 40 returns to its resting position. In this manner, any number of third tanks 16 may be quickly and easily swapped into and out of backpack sprayer system 10 without contaminating the diluent (e.g., water) within first tank 12.

With reference to FIGS. 2-5, first tank 12, second tank 14 and third tank 16 are each individually fluidly coupled to pump unit 18. Pump unit 18 generally comprises a cylinder and piston assembly 42 including a piston 44 located and reciprocally moveable within cylinder 46. Cylinder head 48 of cylinder 46 is coupled to a mounting flange 50. Mounting flange 50 includes an upper flange mount 52 and lower flange mount 54. Upper flange mount 52 is proportioned to receive open end 14*a* of second tank housing 30 in a seal-tight coupling. Lower flange mount 54 is proportioned to receive an opening defined within bottom wall 12*d* of first tank housing 26 in a seal-tight coupling.

Figure 4:
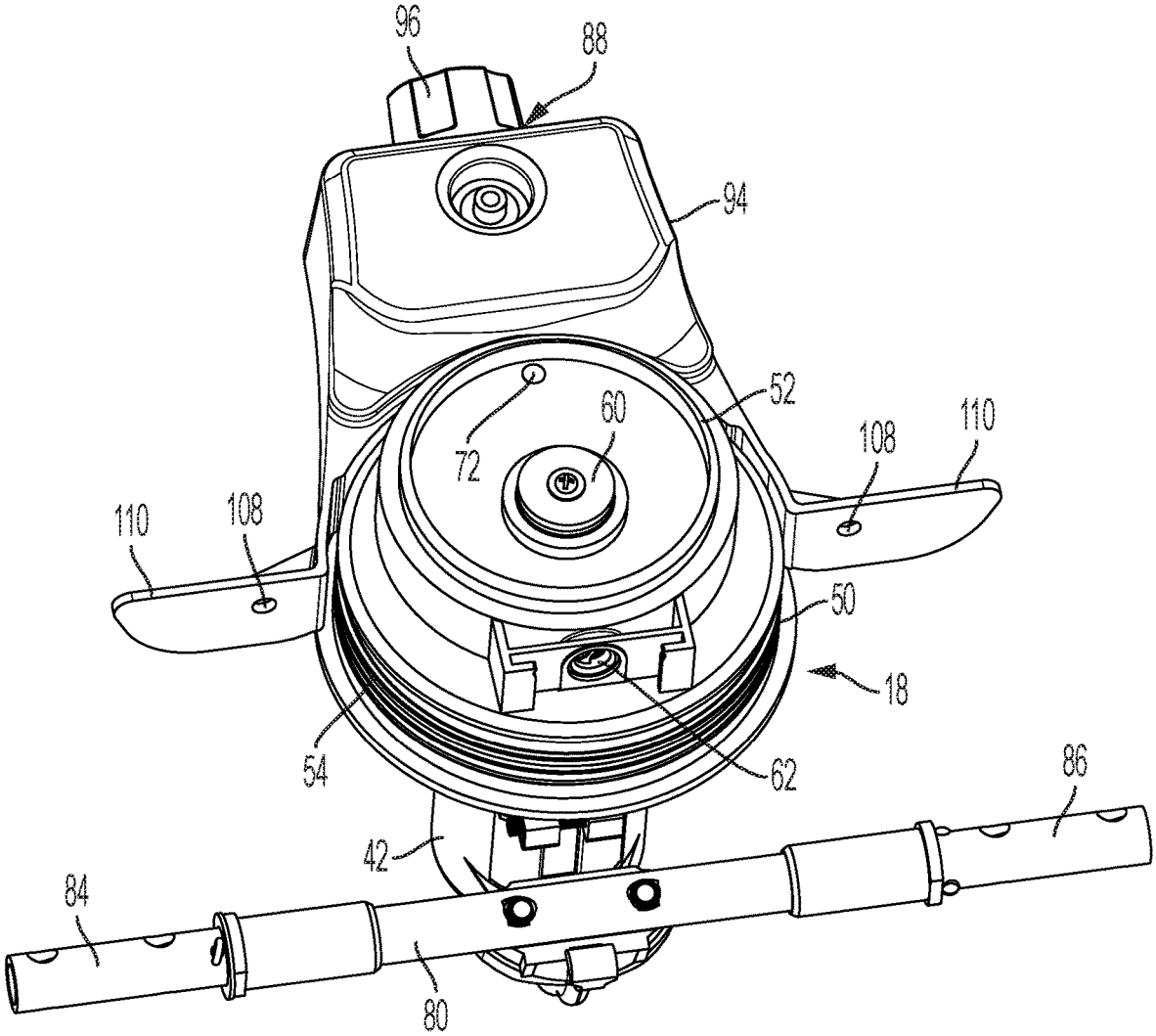
FIG. 4 is a top perspective view of a pump unit and liquid concentrate tank used within the sprayer system shown in FIGS. 1-3.
Figure 5:
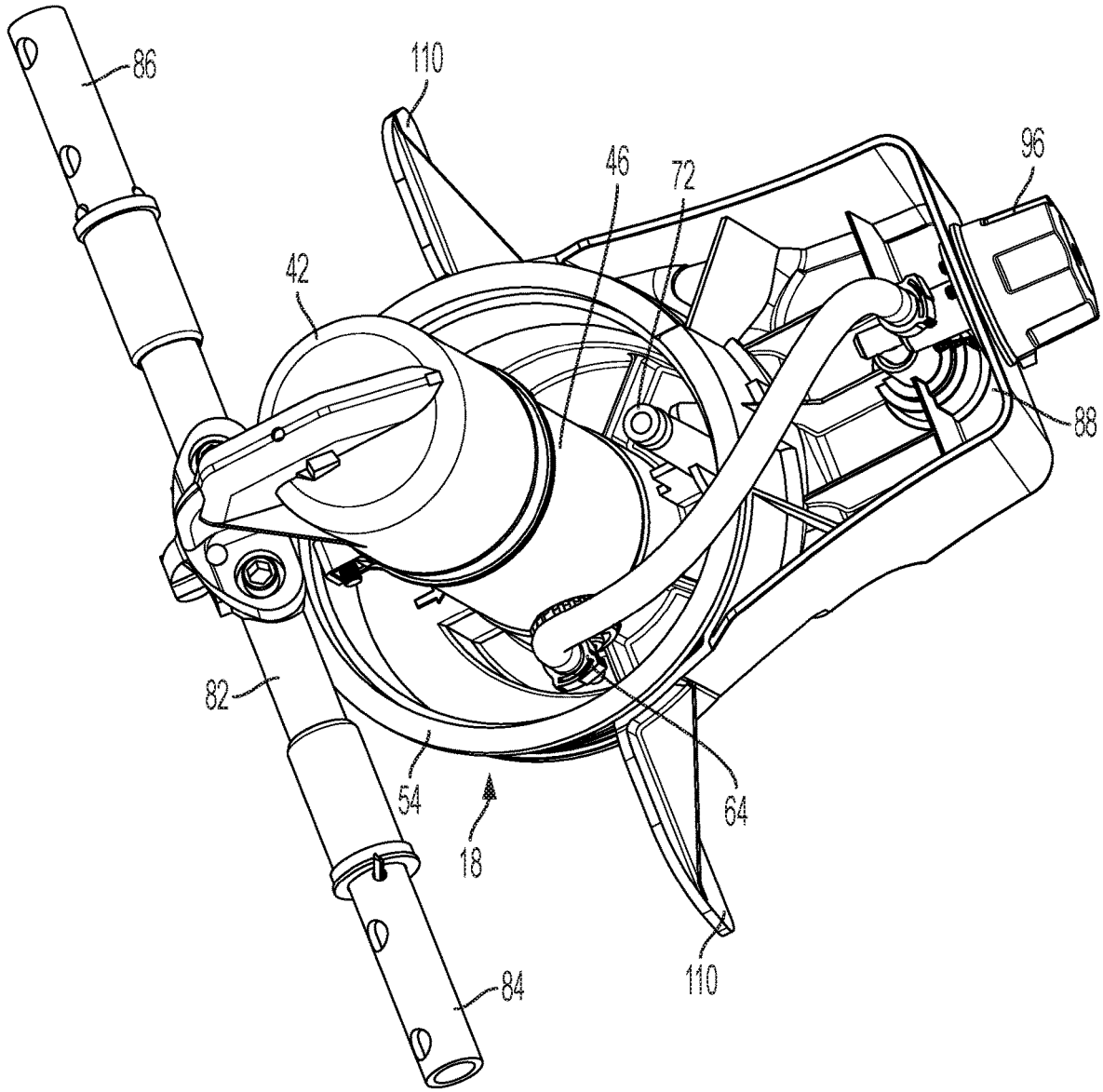
FIG. 5 is a bottom perspective view of the pump unit and liquid concentrate tank shown in FIG. 4.

A pumping chamber 56 is defined within cylinder 46 between piston 44 and cylinder head 48. Pumping chamber 56 is in fluid communication with a discharge port 58 defined within cylinder head 48. Discharge port 58 passes through mounting flange 50 such that when second tank 14 is mounted onto upper flange mount 52, pumping chamber 56 fluidly communicates with pressurized fluid chamber 32. A one-way valve 60 may be coupled with discharge port 58 whereby fluid may only pass from pumping chamber 56 into pressurized fluid chamber 32. To receive fluid therein, pumping chamber 56 is individually fluidly coupled to first tank 12 via first inlet 62 and third tank 16 via second inlet 64. First inlet 62 and second inlet 64 may be defined either within mounting flange 50 (such as first inlet 62 as seen in FIG. 4) or cylinder 46 along pumping chamber 56 (such as second inlet 64 as seen in FIG. 5). Check valves may be included between first tank 12/first inlet 62 and third tank 16/second inlet 64 such that fluid drawn from first tank 12 and third tank 16 is directed only into second tank 14, as will be described in greater detail below.

In operation, piston 44 is translated in a down stroke, such as in a downward direction generally indicated by arrow 66 in FIG. 3. The down stroke of piston 44 creates a vacuum within pumping chamber 56. The vacuum closes one-way valve 60 thereby preventing pressurized fluid within second tank 14 from being drawn into pumping chamber 56. Conversely, the check valves between first tank 12 and pumping chamber 56, and third tank 16 and pumping chamber 56 are opened thereby drawing diluent/water from first tank 12 and liquid concentrate from third tank 16 into pumping chamber 56. Reverse translation of piston 44 in an up stroke (as indicated generally by arrow 68) switches operation of the one-way valve and check valves. As a result, the water/concentrate mixed fluid within pumping chamber 56 is directed into second tank 14 where it is pressurized for eventual delivery to spray wand 70 (FIG. 1). To that end, mounting flange 50 may include a mixed fluid outlet port 72 in communication with pressurized fluid chamber 32. Spray tubing 74 may couple mixed fluid outlet port 72 with spray wand 70. Thus, actuation of trigger 76 will cause pressurized mix fluid within second tank 14 to be emitted from spray wand 70.

In accordance with an aspect of the present invention, pump unit 18 may be a manually actuated pump including a drive shaft 78 coupled to a translating rod 80. Translating rod 80 is coupled to a handle 82 whereby movement of handle 82 in a first direction causes translating rod 80 to rotate so as to drive piston 44 in either a down stroke (arrow 66) or an up stroke (arrow 68). Movement of handle 82 in an opposing second direction causes translating rod 80 to rotate so as to drive piston 44 in the other of the down stroke or up stroke. Handle 82 may be mounted to either end 84, 86 of translating rod 80 so as to enable left- or right-handed operation of pump unit 18.

Figure 6:
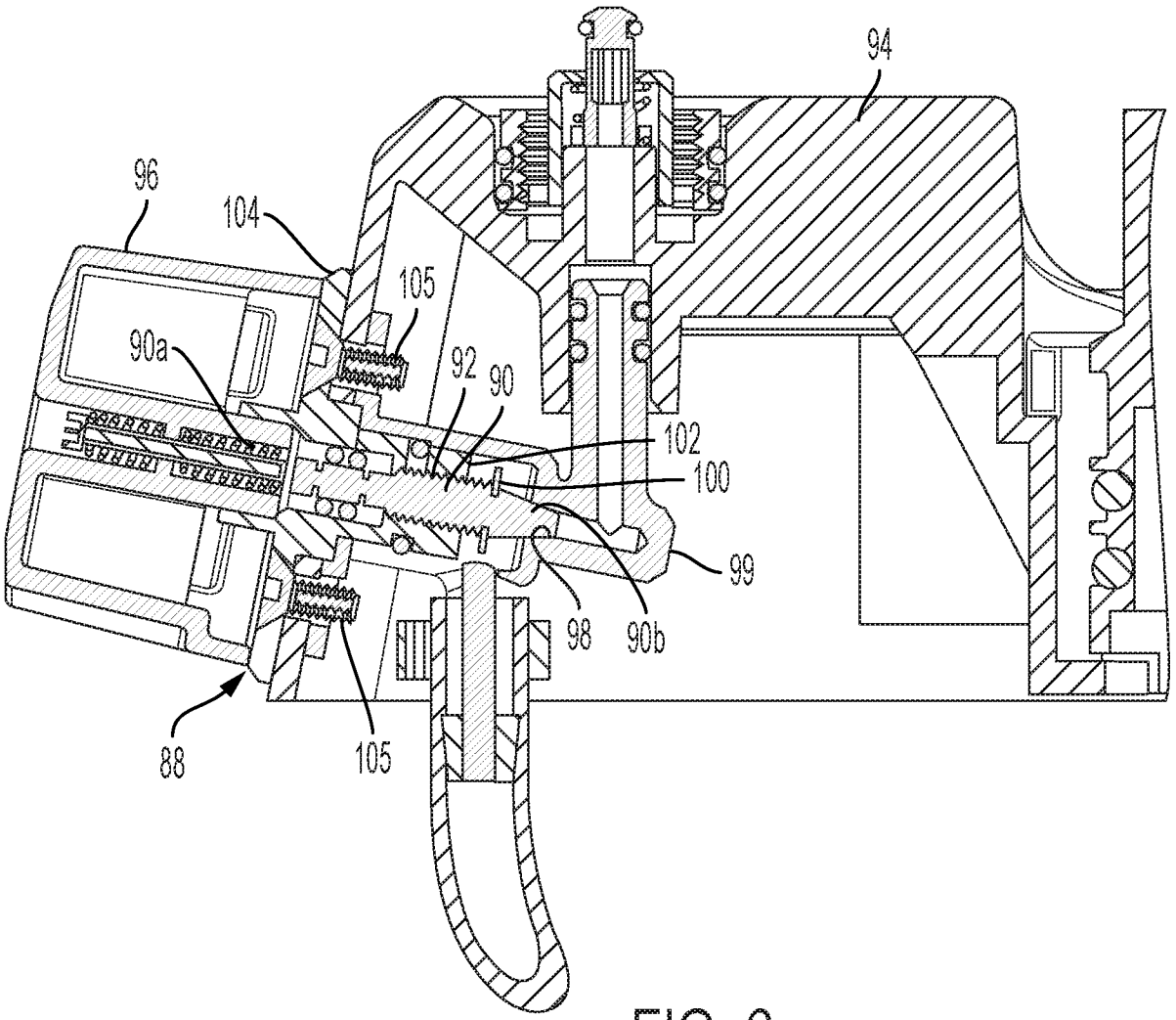
FIG. 6 is an expanded cross section view of a needle valve assembly suitable for user within the sprayer system shown in FIG. 1.

In accordance with a further aspect of the present invention, control over the dilution factor of the liquid concentrate received from third tank 16 may be selectively regulated using a flow control mechanism, such as but not limited to needle valve assembly 88. Needle valve assembly 88 may include a needle valve 90 threadably received within needle shaft portion 92 defined within a valve nut 104 secured to assembly housing 94, such as via screws 105. A knob 96 may be coupled to a first end 90*a* of needle valve 90, whereby turning of knob 96 advances or retreats needle valve 90 within needle shaft portion 92. Distal end 90*b* of needle valve 90 resides within metering shaft portion 98 defined within needle valve coupling 99 mounted within assembly housing 94. Needle valve 90 may selectively translate between a fully closed position, a fully open position and any intermediate position therebetween. When in the fully closed position, distal end 90*b* engages the wall of metering shaft portion 98 (as shown in FIG. 6). In the fully open position, a stop member 100 on needle valve 90 engages a shoulder 102 of valve nut 104.

In accordance with an aspect of the present invention, needle valve assembly 88 and third tank 16 may be mounted to assembly housing 94. Assembly housing 94 may, in turn, be mounted onto frame plate 22, such as via fasteners 106 passing through apertures 108 defined within tabs 110 of assembly housing 94. Fasteners 106 may threadably engage holes 112 defined within front face 114 of frame plate 22. Additionally or alternatively, fasteners 106 may be coupled to a respective nut (not shown) so as to secure assembly housing 94 to frame plate 22. In a further aspect of the invention, assembly housing 94 may be integrally coupled to frame plate 22, such as via a weld, rivet or other non-threaded connection. In still another aspect of the present invention, first tank 12 may also include a pair of wings 116, each including an aperture 118 defined therein. Apertures 118 may coincide with apertures 108 such that fasteners 106 may secure both first tank 12 and third tank 16 to frame plate 22.

Figure 7:
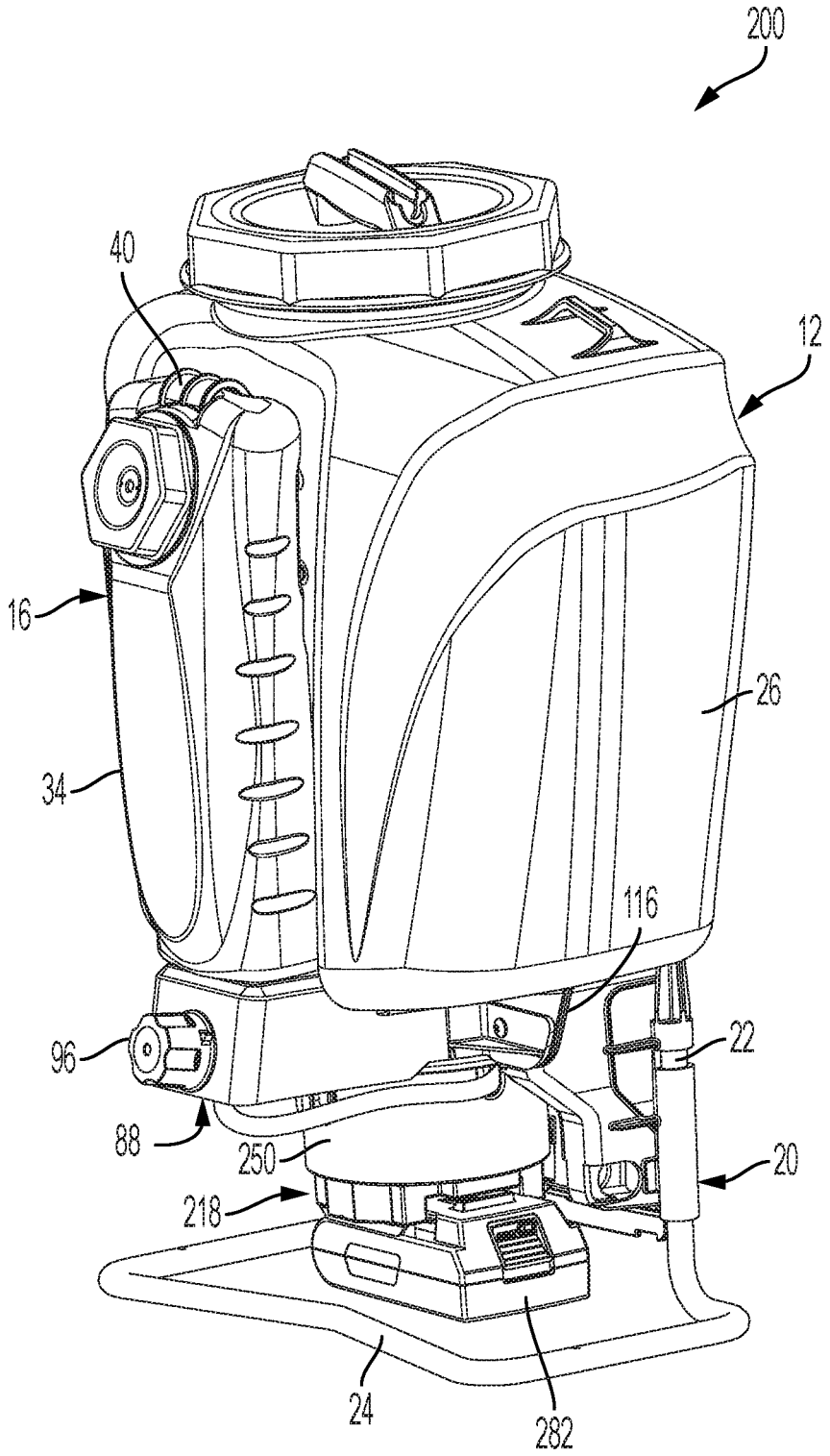
FIG. 7 is a perspective view of a battery powered sprayer system in accordance with an aspect of the present invention.
Figure 8:
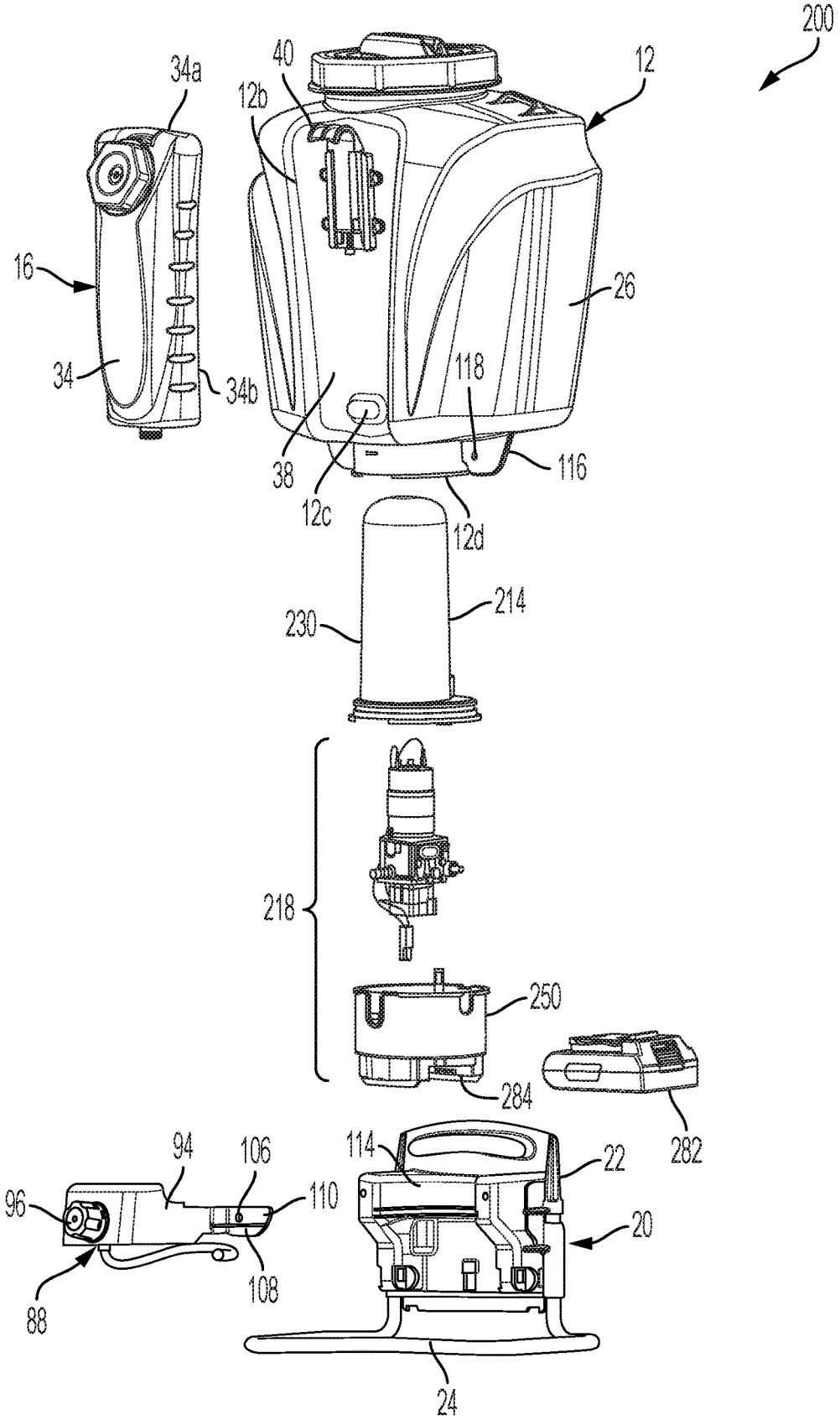
FIG. 8 is an exploded view of the sprayer system shown in FIG. 7.

Turning now to FIGS. 7 and 8, an alternative backpack sprayer system 200 is shown. Backpack sprayer system 200 is substantially identical to backpack sprayer system 10 described above, except backpack spray system 200 is configured to include a battery powered pump unit 218 in place of manually actuated pump unit 18 and associated actuation mechanism, including drive shaft 78, translating rod 80 and handle 82. Additionally, second tank 214 has been modified whereby second tank housing 230 is configured to mount onto and seal against a battery housing 250. Electrical pump 242 is disposed within the cavity formed by coupling second tank housing 230 with battery housing 250. Battery 282, such as a long-life lithium ion battery, is selectively removably inserted within a battery receptacle 284 defined within battery housing 250. Thus, when switched on, battery 282 powers electrical pump 242 to charge second tank 214 with pressurized mixed fluid similar to backpack sprayer system 10 described above.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A dual chamber backpack sprayer system comprising:
a) a first tank including a first tank housing defining an open internal volume configured to hold a diluent therein;
b) a second tank dimensioned to be received within said open internal volume of said first tank housing and configured to hold a pressurized fluid therein;
c) a third tank including a third tank housing configured to hold a liquid concentrate therein; and
d) a pump unit fluidly coupled to said first tank, said second tank and said third tank, whereby said pump unit is configured to receive said diluent from said first tank and said liquid concentrate from said third tank to produce a mixed fluid, whereby said mixed fluid is delivered to said second tank as the pressurized fluid.

2. The dual chamber backpack sprayer system of claim 1 wherein said pump unit is a manually actuated pump or an electrically driven pump.

3. The dual chamber backpack sprayer system of claim 2 wherein said electrically driven pump is a battery powered pump.

4. The dual chamber backpack sprayer system of claim 1 wherein said third tank housing is selectively removably mounted to said first tank housing.

5. The dual chamber backpack sprayer system of claim 1 further including a backpack frame, wherein said first tank is secured to said backpack frame.

6. The dual chamber backpack sprayer system of claim 5 further including a needle valve assembly secured to said backpack frame, wherein said third tank is removable mounted to said needle valve assembly.

7. The dual chamber backpack sprayer system of claim 6 wherein said needle valve assembly includes a needle valve configured to selectively regulate flow of said liquid concentrate from said third tank.

8. The dual chamber backpack sprayer system of claim 6 wherein said first tank and said needle valve assembly are secured to said backpack frame using a common fastener.

* * * * *